US005429114A

United States Patent [19]

Taplan et al.

[11] Patent Number: 5,429,114

[45] Date of Patent: Jul. 4, 1995

[54] COOKTOP UNIT FOR MOUNTING IN A FRAME STRUCTURE OR A CUTOUT

[75] Inventors: Martin Taplan, Ingelheim; Stefan Hubert, Bubenheim; Herwig Scheidler, Mainz, all of Germany

[73] Assignee: Schott Glaswerke, Mainz, Germany

[21] Appl. No.: 281,458

[22] Filed: Jul. 27, 1994

[30] Foreign Application Priority Data

Jul. 27, 1993 [DE] Germany ..... 43 25 168.4

[51] Int. Cl.[6] ..... F24C 15/10

[52] U.S. Cl. ..... 126/211; 126/39 H; 126/214 A; 219/464

[58] Field of Search ..... 126/39 B, 211, 39 H, 126/39 J, 39 R, 39 E, 214, 39 F, 214 A, 214 B; 219/443, 459, 464, 460, 466; 312/296, 140.2, 140.3; 108/42

[56] References Cited

U.S. PATENT DOCUMENTS

| | | | |
|---|---|---|---|
| 4,363,956 | 12/1982 | Scheidler et al. . | |
| 4,453,533 | 6/1984 | Scheidler et al. | 126/211 |
| 4,492,217 | 1/1985 | Scheidler | 219/464 |
| 4,804,822 | 2/1989 | Schreder | 219/458 |
| 5,036,831 | 8/1991 | Ray . | |

FOREIGN PATENT DOCUMENTS

| | | |
|---|---|---|
| 3341194 | 5/1985 | Germany . |
| 2092739 | 8/1982 | United Kingdom . |

*Primary Examiner*—James C. Yeung
*Attorney, Agent, or Firm*—Walter Ottesen

[57] ABSTRACT

The invention is directed to a cooktop unit for mounting in a frame structure or in a cutout of a work surface. The cooktop unit includes a plate made of glass ceramic and this plate defines the cooking surface. The cooktop unit also includes a metal frame permanently-elastically connected by a silicone adhesive to the lower side in the peripheral region of the plate. A leg of the holding frame connected to the cooktop plate extends flush from the edge of the plate inwardly and parallel to the plate and then bends downwardly at right angles to the plate. The adhesive effects the force-tight connection or bond between the plate and the holding frame. The adhesive defines a peripheral silicone flange at the lateral edges of the plate and at the lateral edge of the leg cemented to the plate. This silicone flange terminates flush with the surface of the plate and projects beyond the lower edge of the leg connected to the plate to form a sealing lip.

4 Claims, 2 Drawing Sheets

FIG. 6a
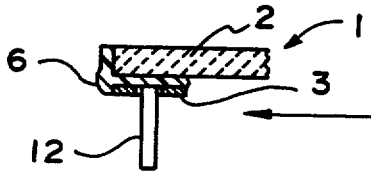
FIG. 6b
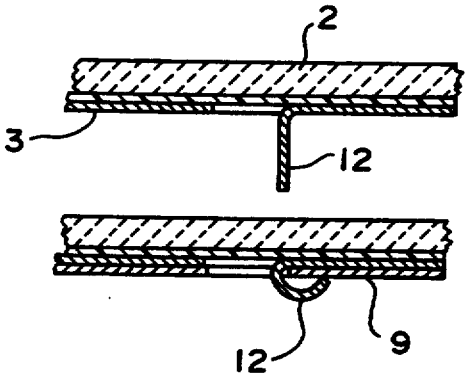
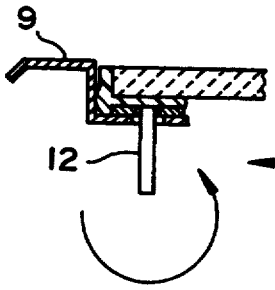
FIG. 6c
FIG. 6d
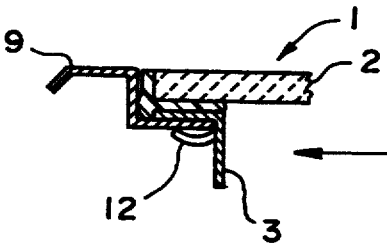
FIG. 7a
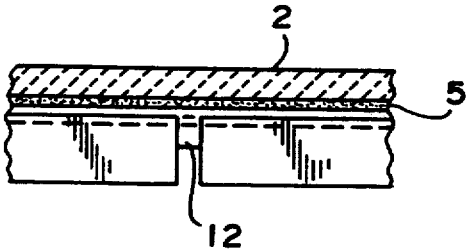
FIG. 7b
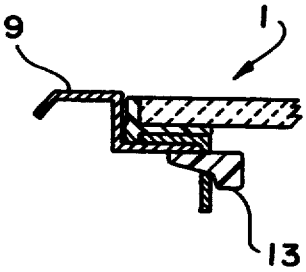
FIG. 8
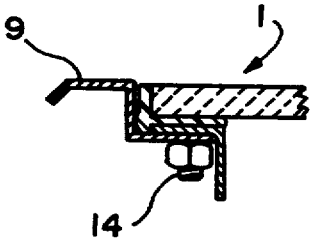
FIG. 9

COOKTOP UNIT FOR MOUNTING IN A FRAME STRUCTURE OR A CUTOUT

FIELD OF THE INVENTION

The invention relates to a cooktop unit for mounting in a frame structure or in a cutout such as in a plate defining a work surface such as a kitchen countertop. The cooktop unit includes a plate made of glass ceramic or a similar material and a holding frame adapted for seating on the frame structure or in the cutout. The glass ceramic functions as a cooktop and the holding frame made of metal is joined by a silicone adhesive to the lower side of the plate at the peripheral region thereof. The silicone adhesive defines a permanent-elastic bond and the holding frame is formed as an angle member having an L-shaped section with one leg thereof being bonded to the cooktop. This leg extends flush from the lateral edge of the plate and parallelly with the plate inwardly and then bends downwardly at right angles to the leg bonded to the plate.

BACKGROUND OF THE INVENTION

A cooktop unit generally comprises: a glass-ceramic cooktop or a cooktop made of similar material; a holding frame; and, a permanent-elastic connection between the cooktop and the frame.

Assemblies are known in the marketplace having a molded-on sealing profile.

This idea in and of itself is good but experience has shown that significant tolerance problems develop when attempting to realize such sealing profiles. This is the case because a seal can be effected only via the periphery and therefore a pressfit must always be ensured. This, however, is not possible because of the tolerances of the cooktop and frame as well as mounting tolerances.

An inadequate seal between the glass-ceramic cooktop and the frame can affect cleaning in practical use and safety during operation. Food being cooked can overflow and trickle into the gap between the seal and the frame and can disadvantageously affect electrical reliability.

U.S. Pat. No. 4,363,956 discloses a glass-ceramic cooktop unit for direct mounting in a workplate of wood, ceramic or plastic (kitchen countertop). This cooktop unit comprises a cooking area with a cookplate made of glass ceramic and the heating elements as well as a peripherally extending mounting frame supporting the cooktop. The mounting frame can be connected, on the one hand, to a peripheral region of the cookplate and, on the other hand, to the periphery of a workplate cutout. Spring elements and adjusting devices are arranged between the cooking area and the mounting frame in order to bring the cooking plate with the cooking area in smooth approximation to the frame against the action of the spring elements.

U.S. Pat. No. 5,036,831 discloses a frameless glass-ceramic cooktop unit which includes the following: a cooktop with a mounting cutout and a peripheral edge in the mounting cutout which includes a flange directed downwardly; a glass-ceramic plate having a peripheral edge; a uniform support ring having first and second essentially planar surfaces with the second planar surface being arranged vertically; and, a sealing material between the first planar surface of the support ring and the lower side of the glass-ceramic plate. This sealing material joins the glass-ceramic plate to the support ring and the second planar surface of the support ring is held against the downwardly extending flange.

The configurations suggested in U.S. Pat. Nos. 4,363,956 and 5,036,831 have been difficult to realize in practice because complex configurations of the mounting frame and adjusting devices and spring elements are expensive to produce and are problematic with respect to installation.

SUMMARY OF THE INVENTION

It is an object of the invention to provide a cooktop unit without the above disadvantages. It is another object of the invention to provide a cooktop which can be mounted in a simple manner and is easily accessible for service. A permanent elastic and tight bond between the glass-ceramic plate and the holding frame is ensured even when geometric tolerances are present between the glass-ceramic plate and holding frame. In addition, it is an object of the invention to ensure the safety of the user at all times.

It is still another object of the invention to provide a preassembled cooktop unit which includes an adhesive on the lateral edges of the plate and the leg of the holding frame cemented to the plate. The adhesive effects a form-tight connection between the plate and the holding frame. The adhesive forms a peripheral first flange and this flange extends flush to the surface of the plate and the adhesive forms a second flange which projects beyond the lower side of the leg connected to the plate to form a sealing lip.

The sealing connection between the first and second flanges and the sealing frame or the mounting cutout is now not effected via the vertical sealing periphery, but instead is placed in the horizontal plane. The solution provided by the invention is in the form of a molded-on sealing lip and surprisingly meets all requirements in a simple manner.

The cooktop unit of the invention therefore includes: a cooktop made of glass ceramic or a similar material; a holding frame; and, a permanent-elastic formed adhesive flange defining a sealing lip.

The sealing lip defines the seal between the cooktop unit and the sealing frame or the mounting cutout independently of the manufacturing and assembly tolerances of the cooktop, on the one hand, and of the sealing frame or the mounting cutout, on the other hand.

The sealing action in the embodiment of the invention is not effected via the vertical flank of the adhesive flange but instead via a formed sealing lip. For this reason, one is no longer restricted by the high requirements as to tolerances of the adhesive device, the sealing frame and the mounting cutout.

The seal can therefore be simply and quickly produced.

Two methods of producing the seal are especially preferred. The first is to produce the seal in a so-called mold or form in which the cooktop unit is to be completely preassembled. In order later to be able to easily remove the cooktop unit, a separating means is introduced into the mold or the mold itself is made of a suitable material such as polytetrafluoroethylene (PTFE) which, in and of itself, exhibits a separating action. A second method provides for producing the cooktop unit directly in the frame.

In a preferred embodiment, the thickness of the flange formed by the adhesive is 1.5 mm to 3.5 mm and the sealing lip has a radius ≦0.5 mm. In this way, a reliable operation of the frame is always obtained.

The preassembled cooktop unit having the sealing lip can be mounted in any conventional frame. A good seal is provided with the sealing lip of the invention for sealing frames having a separate support leg as well as for sealing frames made of deep-drawn profiles or extrusion profiles made of metal or plastic and also for simple mounting cutouts such as a sheet metal pan of a hob.

The connection of the cooktop unit of the invention to the sealing frame is provided in a simple manner such as by means of a bendable lug which is provided on the leg cemented to the lower side of the glass-ceramic plate or on the leg extending freely downwardly and is so bent over that it provides a form-tight connection to the sealing frame. Further possibilities of providing the connection to the sealing frame are wedges such as plastic wedges or by a threaded connection using a threaded bolt.

BRIEF DESCRIPTION OF THE DRAWINGS

The invention will now be described with reference to the drawings wherein:

FIGS. 6*a* to 6*d* show how the cooktop unit is connected to the sealing frame according to a feature of the invention;

FIGS. 7*a* and 7*b* show another embodiment of the invention wherein the free leg is not connected to the glass-ceramic cooktop plate;

FIG. 8 is a schematic of the cooktop unit of the invention attached by means of a plastic wedge; and, FIG. 9 shows the connection of the cooktop unit in the sealing frame by means of a threaded bolt.

DESCRIPTION OF THE PREFERRED EMBODIMENTS OF THE INVENTION

Figure 1A:
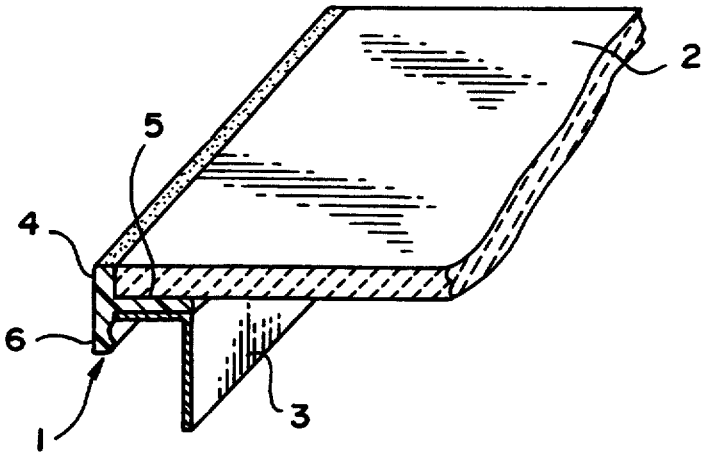
FIG. 1*a* is a perspective section view of a finished cooktop unit according to the invention.
Figure 1B:
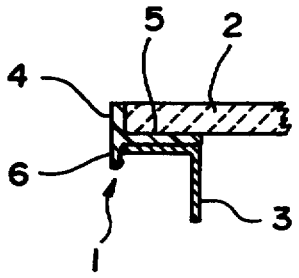
FIG. 1*b* is a section view, in elevation, of the finished cooktop unit of FIG. 1*a;*

FIGS. 1*a* and 1*b* show a finished cooktop unit 1 which includes a glass-ceramic plate 2 and a holding frame 3 formed as an angle member having an L-shaped section. The holding frame 3 is joined to the lower side of the glass-ceramic plate 2 by a silicone adhesive 5. The silicone adhesive 5 then defines a 2.5 mm thick silicone flange 4 on the lateral edge of the plate 2. The silicone flange defines a sealing lip 6 which also projects over the peripheral edge of the frame 3.

Figure 2:
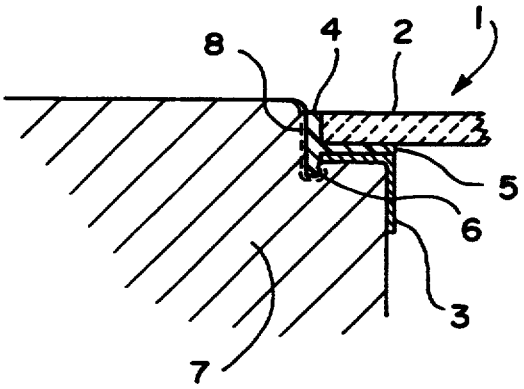
FIG. 2 is a schematic showing how the complete cooktop unit is produced.

FIG. 2 shows the concept pursuant to which the completed cooktop unit 1 having the sealing lip 6 is produced. The cooktop unit is produced with the aid of a form V made of polytetrafluoroethylene. In this way, an otherwise necessary separation means 8 is no longer necessary. The form corresponds to the negative of a modified original sealing frame.

FIG. 2 shows a glass-ceramic plate 2 bonded to a frame 3 by means of a permanent-elastic silicone adhesive 5. The frame 3 is placed upon the form V. The silicone adhesive 5, which later forms the silicone flange 4, is introduced between the form V and the lateral edges of the glass-ceramic plate 2 and between the form and the holding frame 3. The form V is so configured that the silicone flange 4 is formed downwardly to form a sealing lip 6 which projects clearly beyond the leg of the holding frame 3 by 3 mm. This leg of the holding frame 3 is joined to the glass-ceramic plate 2.

The assembled cooktop unit 1 shown in FIGS 1*a* and 1*b* is then removed from the form and seated in the original sealing frame.

The manufacture by means of a slightly modified original sealing frame takes place in a simple manner. However, the frame must be provided with separating means.

Figure 3:
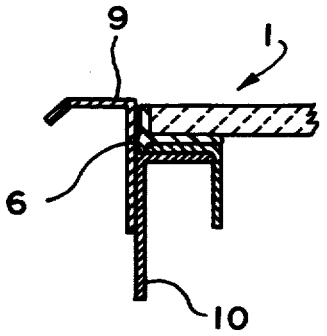
FIG. 3 shows a simple seal provided by the sealing lip of the preassembled cooktop unit shown in FIGS. 1*a* and 1*b;*

FIG. 3 shows the simple sealing by means of the sealing lip 6 of the preassembled cooktop unit 1 mounted in a sealing frame 9 having a separate support leg 10.

Figure 4:
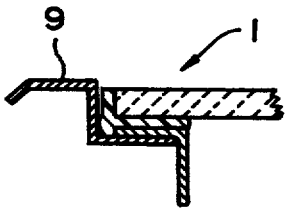
FIG. 4 shows the cooktop unit according to the invention assembled in a sealing frame.

FIG. 4 shows the cooktop unit 1 of the invention mounted in a sealing frame 9 which is made of metal or plastic by means of deep drawing or extrusion.

Figure 5:
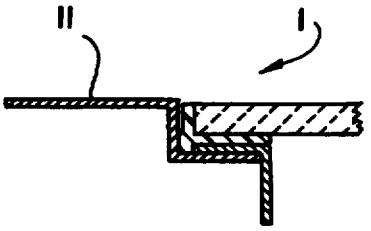
FIG. 5 shows the cooktop unit according to the invention mounted in a sheet metal pan of a hob.

FIG. 5 shows the cooktop unit 1 of the invention in a mounting cutout 11 such as a sheet metal pan of a hob.

FIGS. 6*a* to 6*d*, FIGS. 7*a* and 7*b*, FIG. 8 and FIG. 9 all show embodiments for joining to pregiven sealing frames.

FIGS. 6*a* to 6*d* show an embodiment for connecting the cooktop unit 1 to the sealing frame 9 by means of a bentover lug 12. The lug 12 of the frame 3 is connected to the glass-ceramic plate 2 in the embodiment shown in FIGS. 6*a* to 6*b*.

In the embodiment shown in FIGS. 7*a* arid 7*b*, the lug 12 is provided on the free leg of the frame 3 not connected to the plate 2.

In FIG. 8, an assembled cooktop unit 1 is shown which is attached by means of a plastic wedge 13; whereas, in FIG. 9, the cooktop unit 1 is connected to the sealing frame 9 or built-in cutout 11 by means of a threaded bolt 14.

The invention shows a simple and economical way of achieving an effective seal between a cooktop unit and a sealing frame or a mounting cutout. The seal is defined by a sealing lip which is molded to the silicone flange.

It is understood that the foregoing description is that of the preferred embodiments of the invention and that various changes and modifications may be made thereto without departing from the spirit and scope of the invention as defined in the appended claims.

What is claimed is:

1. A preassembled cooktop unit for mounting in a seat without adhesive defined by a frame structure or a cutout in a plate defining a work surface such as a kitchen countertop, the preassembled cooktop unit before mounting in said seat comprising:

a non-metal plate defining an upper surface for cooking and having a peripheral lateral edge and a lower surface;

said lower surface having an edge region extending around the periphery of said lower surface;

a metal holding frame adapted to fit on said seat;

said holding frame being an angular member having first and second legs conjointly defining an L-shaped cross section;

a silicone adhesive body having a first portion defining a permanent-elastic bond joining said first leg of said holding frame to said plate at said lower surface;

said first leg having an outer edge flush with said lateral edge and said first leg extending parallel to said lower surface inwardly where said second leg extends downwardly away from said lower surface;

said silicone adhesive body including a second portion formed on said first portion;

said second portion being conjointly defined by first and second flanges; said first flange extending upwardly from said bond so as to be in contact engagement with said peripheral lateral edge of said plate and so as to terminate flush with said upper surface of said plate whereby said first flange effects a seal by pressing with respect to said seat when said cooktop unit is placed thereon; and, said second flange extending downwardly from said bond to form a sealing lip which extends downwardly beyond said outer edge of said first leg to also effect a seal by pressing against said seat when said cooktop unit is mounted thereon.

2. The cooktop unit of claim 1, wherein said second portion of said adhesive body has a thickness in the range of 1.5 mm to 3.5 mm.

3. The cooktop unit of claim 2, wherein said sealing lip has a peripheral edge having a radius equal to or greater than 0.5 mm.

4. The cooktop unit of claim 1, said first leg having an upper flat surface in direct adhering contact with said first portion of said silicone adhesive body and a lower flat surface devoid of any portion of said silicone adhesive body before and after said preassembled cooktop unit is pressed against said seat.

* * * * *

UNITED STATES PATENT AND TRADEMARK OFFICE
CERTIFICATE OF CORRECTION

PATENT NO. : 5,429,114

DATED : July 4, 1995

INVENTOR(S) : Martin Taplan, Stefan Hubert and Herwig Scheidler

It is certified that error appears in the above-identified patent and that said Letters Patent is hereby corrected as shown below:

In column 3, line 62: delete "form V" and substitute -- form 7 -- therefor.

In column 3, line 68: delete "form V" and substitute -- form 7 -- therefor.

In column 4, line 2: delete "form V" and substitute -- form 7 -- therefor.

In column 4, line 4: delete "form V" and substitute -- form 7 -- therefor.

In column 4, line 33: delete "arid" and substitute -- and -- therefor.

Signed and Sealed this

Twenty-ninth Day of August, 1995

*Attest:*

Bruce Lehman

BRUCE LEHMAN

*Attesting Officer*

*Commissioner of Patents and Trademarks*